US006487903B2

(12) United States Patent
Sabini et al.

(10) Patent No.: US 6,487,903 B2
(45) Date of Patent: Dec. 3, 2002

(54) METHOD AND SYSTEM FOR DETERMINING PUMP CAVITATION AND ESTIMATING DEGRADATION IN MECHANICAL SEALS THEREFROM

(75) Inventors: Eugene P. Sabini, Skaneateles, NY (US); Jerome A. Lorenc, Seneca Falls, NY (US); Oakley Henyan, Auburn, NY (US); Kenneth L. Hauenstein, Seneca Falls, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/841,141

(22) Filed: Apr. 24, 2001

(65) Prior Publication Data

US 2002/0152807 A1 Oct. 24, 2002

(51) Int. Cl.[7] ..... G01L 7/00; G01M 19/00; G01M 11/00

(52) U.S. Cl. ..... 73/168; 73/1.71; 417/38; 417/44.2; 417/44.3; 417/212; 417/309

(58) Field of Search ..... 73/168

(56) References Cited

U.S. PATENT DOCUMENTS 3,910,216 A * 10/1975 Shultz ..... 114/275
5,041,989 A * 8/1991 Kataoka et al. ..... 340/679
5,772,403 A * 6/1998 Allison et al. ..... 417/44.2
5,833,501 A * 11/1998 Jones ..... 440/1
6,082,737 A * 7/2000 Williamson et al. ..... 277/317
6,167,965 B1 * 1/2001 Bearden et al. ..... 166/105.5

OTHER PUBLICATIONS

Perez, R. et al., "Using Fiber–Optic Pressure Sensors to Detect Cavitation and Flow Instabilities in Centrifugal Pumps", Pumping Technology Magazine, Jun. 1998, pp. 170–174.*

Carlson, B., "Avoiding Cavitation in Control Valves", ASHRAE Journal, vol. 43, No. 6, Jun. 2001, pp. 58–61.*

* cited by examiner

*Primary Examiner*—Hezron Williams
*Assistant Examiner*—David Rogers

(57) ABSTRACT

A method and system for determining pump cavitation is disclosed. In accordance with the principle of the invention, changes in dynamic fluid pressure within a pump are monitored and compared to a determined cavitation alarm pressure. The determined cavitation pressure is determined as a known percentage of a known non-cavitation pressure. Fluid cavitation is determined when the change in dynamic fluid pressure falls below the determined cavitation alarm pressure. In a further aspect of the invention, a remaining mechanical seal operational life can be determined by maintaining a total time of fluid cavitation and reducing the expected life by the known operational time of the pump and the time the pump is in cavitation.

33 Claims, 7 Drawing Sheets

METHOD AND SYSTEM FOR DETERMINING PUMP CAVITATION AND ESTIMATING DEGRADATION IN MECHANICAL SEALS THEREFROM

FIELD OF THE INVENTION

This invention relates to fluid flow through pumps. More specifically, this invention relates to determining fluid cavitation and an estimate of mechanical seal failure caused by such cavitation.

BACKGROUND OF THE INVENTION

Fluid pumps and their associated technology are well-known in the art. Pumps typically are incorporated into fluid transport systems to change the direction of the fluid flow or to increase rate or pressure of the fluid flow. Ideally, fluid transport systems require little or no maintenance. One feature of fluid pumps is that the fluid being pumped is used as a lubricant to reduce the wear on the pump's internal components. For example, the pumped fluid provides a liquid surface boundary layer, which prevents the components of mechanical seals from coming into contact.

When a low pressure condition occurs in a pump, vapor bubbles exit the pumped fluid and begin a process, i.e., cavitation that can cause failure in the pump. In one case, vapor bubbles impact with, and implode on, the impeller blades of the pump. Because of the high speed of the impeller blades, the continuous impact of vapor bubbles can damage the impeller blades. Furthermore, the vapor bubbles have an insufficient consistency to maintain a boundary layer between mechanical seal components. Thus, the mechanical seal components can come into contact, which generates heat and wear.

Methods of determining cavitation are well known in the art. One method, for example, measures the pump's suction pressure and pump temperature. From these measurements and known vapor pressure/temperature curves, a Net Positive Suction Head Available (NPSHa) is computed. The NPSHa is then compared to an NPSHr (Net Positive Suction Head Required) for the measured pump speed. When NPSHr is greater than NPSHa, the fluid in the pump is deemed to be cavitating. A second method identifies high frequency noise, which is indicative of cavitation, in a pump bearing housing, a suction flange case or a mechanical seal chamber. A third method is to measure pressure and temperature in the mechanical seal chamber and infer vaporization across the mechanical seal face. Each of these methods had known disadvantages. The first method requires measurements of at least four variables, which imposes additional hardware costs on the pump. The second method can falsely indicate cavitation as other conditions can create high frequency noises. The third method provides an indication of vaporization across the mechanical seal face and not pump fluid cavitation.

Hence, there is a need to provide a simple and reliable method of determining pump cavitation and when possible an estimate of the degradation in seal life caused by cavitation and the remaining useable life of the seal.

SUMMARY OF THE INVENTION

A method and system for determining cavitation in a pump having a known non-cavitating dynamic pressure measure, is disclosed. In accordance with the principles of the invention, fluctuations of the pressure with the pump, i.e., the dynamic pressure, are recorded and compared to a known cavitation alarm dynamic pressure. The cavitation alarm dynamic pressure is a known percentage of the non-cavitating pressure measurement. When measured dynamic pressure is determined to be less than the cavitation alarm pressure, an indicator is made available, i.e., output, to indicate the occurrence of cavitation. In a further aspect of the invention, remaining seal life can be determined by maintaining the time cavitation is present and determining a seal degradation time relating to the pump cavitation time and a seal degradation factor. The seal degradation time can then be removed from the expected operational seal life to determine the remaining usable seal life.

Figure 1A:
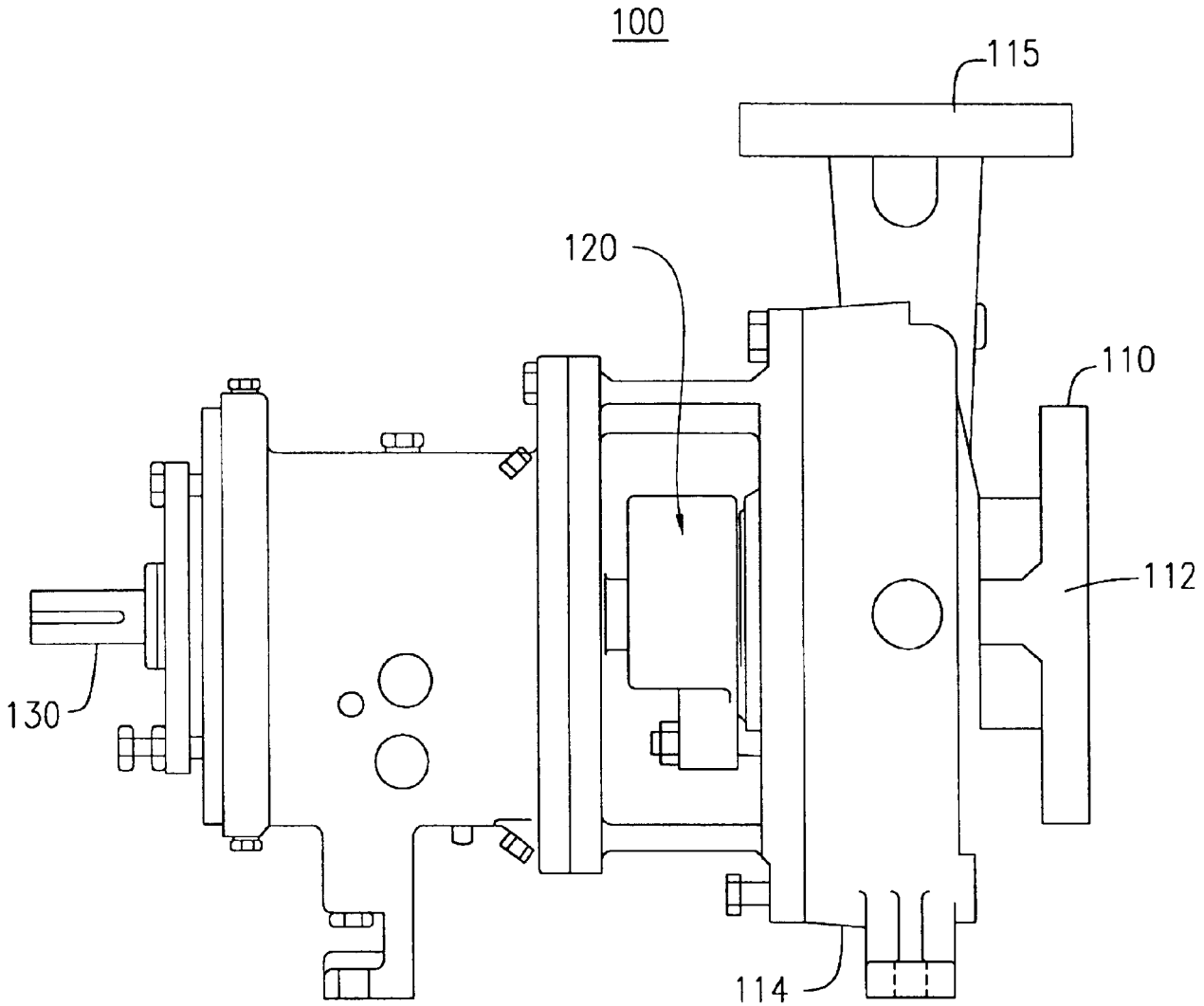
(PRIOR ART) FIG. 1a
FIG. 1*a* illustrates a conventional fluid pump system.

It is to be understood that these drawings are solely for purposes of illustrating the concepts of the invention and are not intended as a level of the limits of the invention. It will be appreciated that the same reference numerals, possibly supplemented with reference characters where appropriate, have been used throughout to identify corresponding parts.

DETAILED DESCRIPTION OF THE INVENTION

FIG. 1*a* illustrates a conventional end suction pump 100 including pump suction nozzle 110, fluid flow inlet 112 impeller section 114, pump discharge nozzle 115 and mechanical seal chamber 120. Shaft 130 is in communication with a motor (not shown), which impairs a rotational motion (torque) onto shaft 130 that turns impeller 145 (not shown).

Figure 1B:
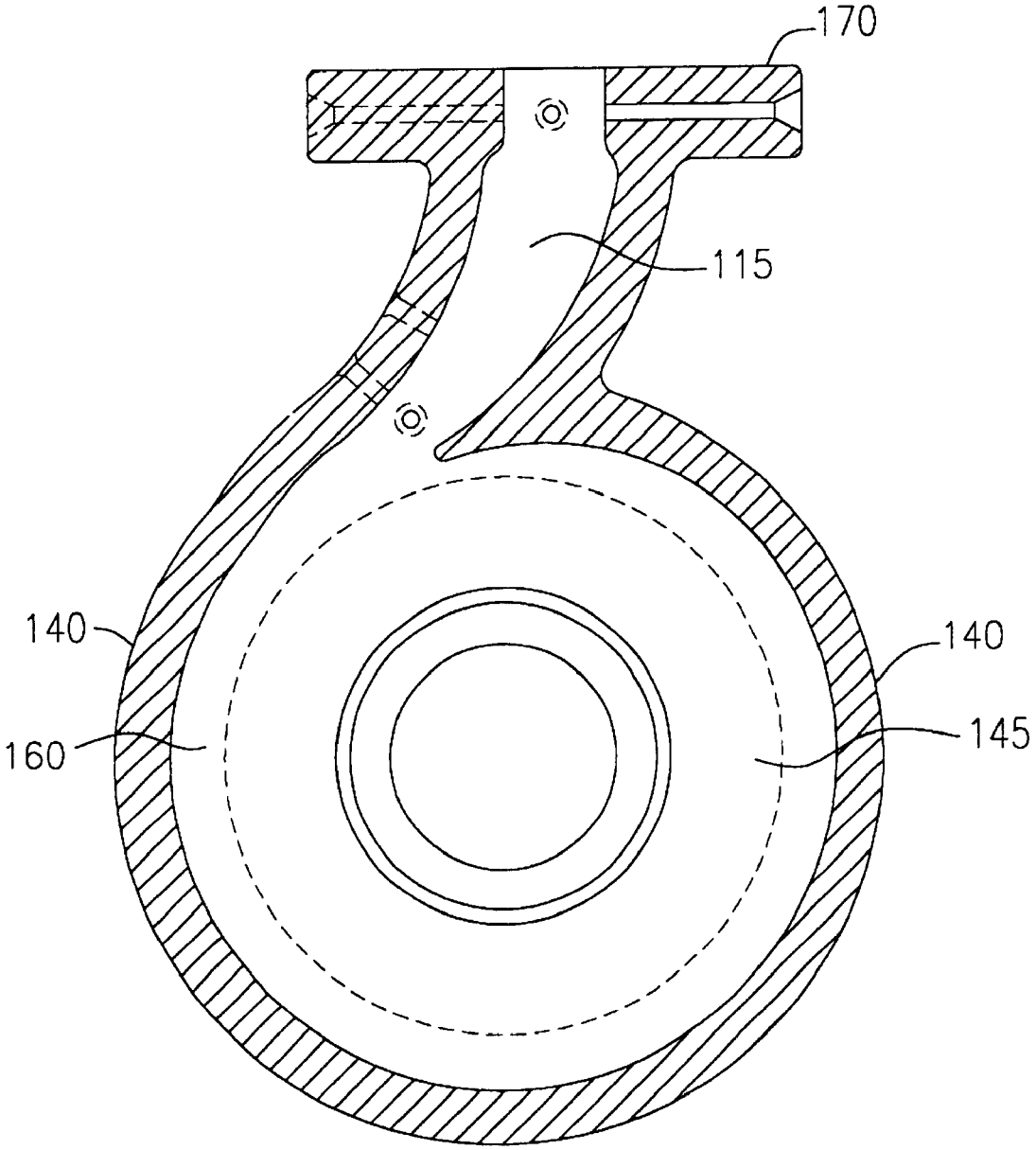
(PRIOR ART) FIG. 1b
FIG. 1*b* illustrates a cross-sectional view of the pump system illustrated in FIG. 1*a;*

FIG. 1*b* illustrates a cross section view of impeller section 114 having a casing 140, impeller 145, an impeller drive shaft 130, which is connected to a drive motor (not shown), a pump discharge outlet 115, and a pump outlet attachment flange 170.

Figure 1C:
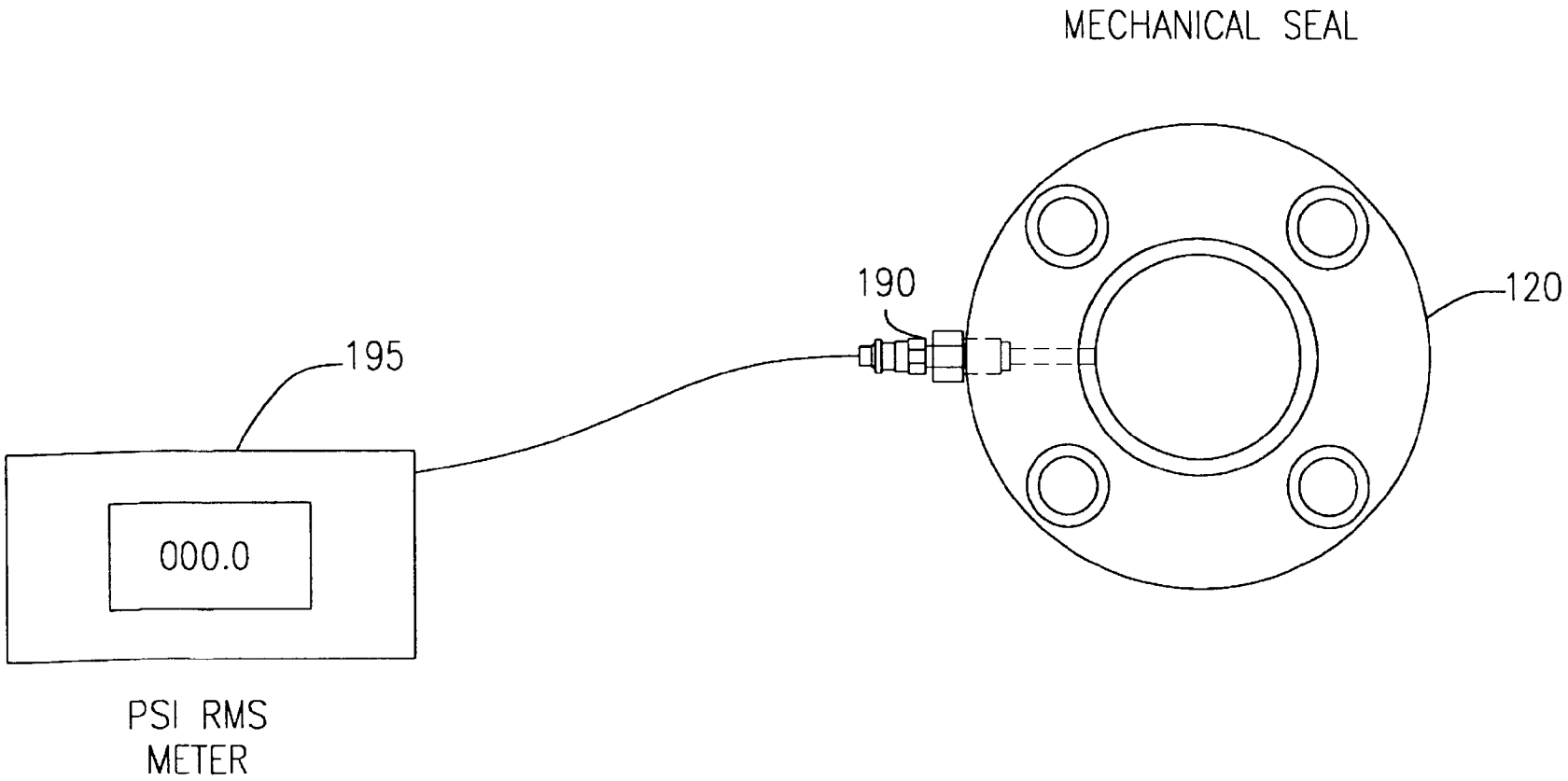
(PRIOR ART) FIG. 1c
FIG. 1*c* illustrates a cross-sectional view of a sensor incorporated into the pump system illustrated in FIG. 1*b;*

FIG. 1*c* illustrates a cross section view of sensor 190 incorporated into, in this case, mechanical seal 120, to determine pressure therein. Sensor 190 is further illustrated in communication with a monitor device 195, which records the pressure readings measured by sensor 190. As is known, sensor 190 may be such that a static pressure or a dynamic pressure within the illustrated mechanical seal chamber is measured. A static pressure sensor measures an absolute pressure within the chamber, whereas a dynamic pressure sensor measures the change in pressure within the chamber. In the example of measuring dynamic pressure, monitor device 195 can determine the RMS (root mean square) change in pressure within the chamber.

Figure 2:
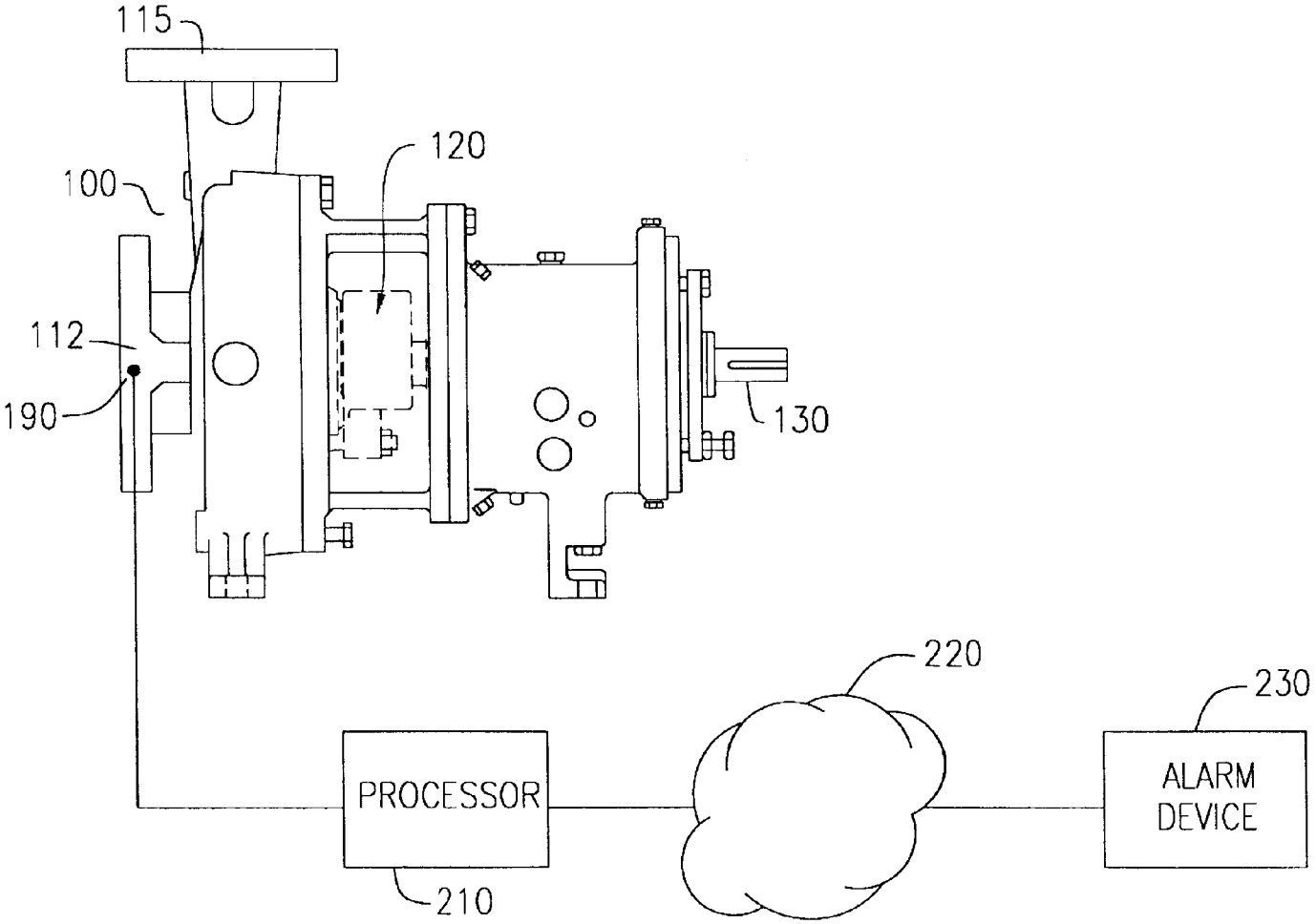
FIG. 2 illustrates an exemplary embodiment of a system for determining pump cavitation in accordance with the principles of the invention.

FIG. 2 illustrates an exemplary embodiment of a system in accordance with the principles of the invention. In this exemplary embodiment, sensor 190 is housed within pump suction nozzle 110 of pump 100 and is in communication with processing unit 210. Sensor 190 measures changes in fluid pressure within fluid flow inlet 112.

Measured changes in fluid pressure are provided to processor 210, which determines a measure of the dynamic fluid pressure. In a preferred embodiment, processor 210 determines a RMS (root mean square) value of the dynamically changing pressure. Determination of the RMS value of a plurality of measured values is well-known in the art and need not be discussed in detail herein.

Processor 210 further compares the determined dynamic RMS pressure value to a known cavitation alarm level. In accordance with one aspect of the invention, a cavitation alarm level is determined as a known percentage of a known non-cavitation dynamic pressure level. The cavitation alarm pressure level may be set in the range of 10 to 90 percent of the non-cavitation dynamic pressure level. In a preferred embodiment, cavitation alarm pressure is set as fifty (50) percent of the non-cavitation dynamic pressure level. Non-cavitation pressure level can be determined by the measurement of the pump pressure under, known, non-cavitating conditions. Measurements of pump pressure under non-cavitating conditions is well-known in the art.

When the dynamic RMS pressure value is determined to be below the known cavitation alarm level, then an indication is made available to indicate the occurrence of a cavitation condition. The indication of pump cavitation can be transmitted, to an alarm device 230 or, as illustrated, over a communication network 220, such as the Internet, Public Switch Network, etc., to alarm device 230, such as a distributed central system, enterprise monitoring system, etc. The indication of pump cavitation can also be transmitted via wireless or infra-red devices to network 220 or to alarm device 230.

In another aspect of the invention, although not illustrated, it would be appreciated, that processor 210 can be incorporated into sensor 190. In this configuration, the indication of pump fluid cavitation, or lack thereof, may be transmitted over network 220, for example.

Figure 3:
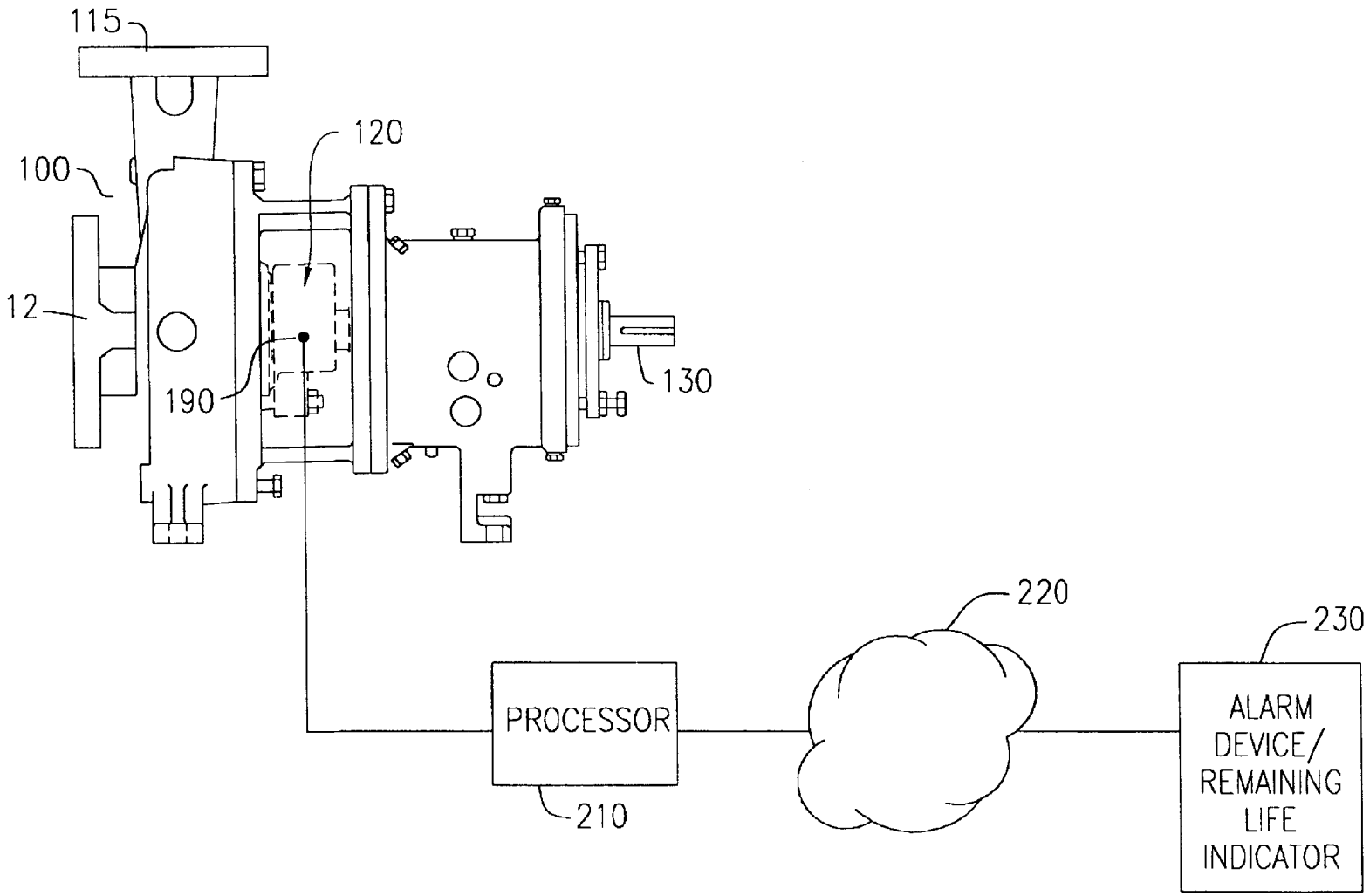
FIG. 3 illustrates an exemplary embodiment of a system for determining pump cavitation and degradation of mechanical seal life in accordance with the principles of the invention.

FIG. 3 illustrates a second embodiment of the invention. In this embodiment of the invention, sensor 190 is included within the mechanical seal section 120 of pump 100 and the dynamic pressure changes occurring within mechanical seal section 120 are evaluated to determine pump fluid cavitation. Furthermore, the degradation on mechanical seal life caused by pump fluid cavitation may be estimated and a remaining mechanical seal life can be determined.

In this embodiment of the invention, sensor 190 measures dynamic changes in the fluid pressure in the mechanical seal chamber, and provides this measured value to processor 210. Processor 210 evaluates the received measured dynamic pressure values in view of a known cavitation alarm pressure level. When the dynamic pressure change falls below the known cavitation alarm level, an indication is provided to indicate the occurrence of cavitation.

Processor 210 further determines the time duration of pump cavitation by the occurrence or lack thereof of the fluid cavitation indication. For example, in one aspect of the invention, the indication of cavitation occurrence may start a timer or counter which records the time from the occurrence of fluid cavitation. When fluid cavitation no longer is present, the lack of a cavitation indication can then halt the recording of time the fluid is in a cavitation state. The recorded duration of pump fluid cavitation can then be accumulated with prior time durations of pump fluid cavitation to obtain a total time of cavitation. Processor 210 can then estimate the degradation in seal life from the total time of cavitation and a seal life degradation factor. Seal life degradation factor can be determined for different pump types, according, for example, to the type of pump, the type of fluid being pumped, the fluid pressure and the fluid velocity. Processor 210 can then estimate the remaining seal life by reducing a known seal life expectancy by the time of pump operation and the estimate of pump cavitation degradation.

Figure 4:
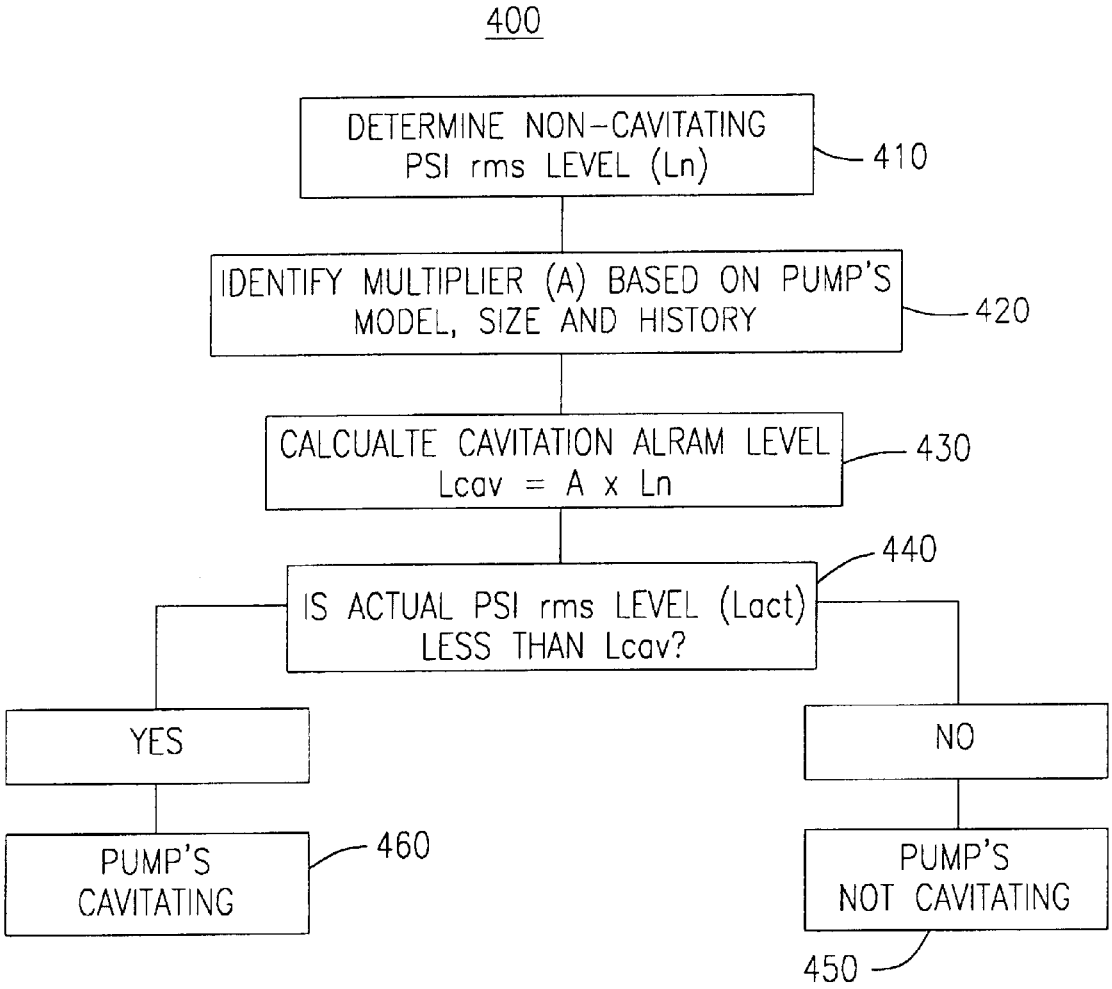
FIG. 4 illustrates an exemplary processing flow chart for determining pump cavitation in accordance with the principles of the invention.

FIG. 4 illustrates an exemplary processing flow chart 400 for determining pump cavitation in accordance with the principles of the invention. In this process a non-cavitating pressure, referred to as Ln, is determined at block 410. Measurement of a non-cavitating pressure value is well known in the art and need not be discussed in detail herein.

At block 420, a pump cavitation factor is determined based on a pump model, size, activity history, etc. The pump cavitation factor is selected in the range of 0.1–0.9. In a preferred embodiment, the pump cavitation factor is selected substantially equal to 0.5. At block 430, a cavitation alarm level, referred to herein as Lcav, is determined as a percentage of the non-cavitating pressure value. At block 440, a determination is made whether the currently measured pressure RMS value (Lact) is less than cavitation alarm pressure, Lcav. If the answer is in the negative, than at block 450, the pump is deemed not in a cavitation state. A cavitation indicator is reset and the process continues by returning to block 440 to monitor a measure of dynamic pressure with regard to cavitation alarm pressure.

If however, the answer is in the affirmative, then at block 460 a cavitation indicator is set to indicate that the pump fluid is in a cavitation state. In one aspect of the invention, the cavitation indicator may the set at a known level for the duration of the period of fluid cavitation. In a second aspect of the invention, cavitation indicator can be made available at the occurrence of fluid cavitation and a second indicator made available to indicate that the pump fluid is no longer in a cavitating state.

Figure 5:
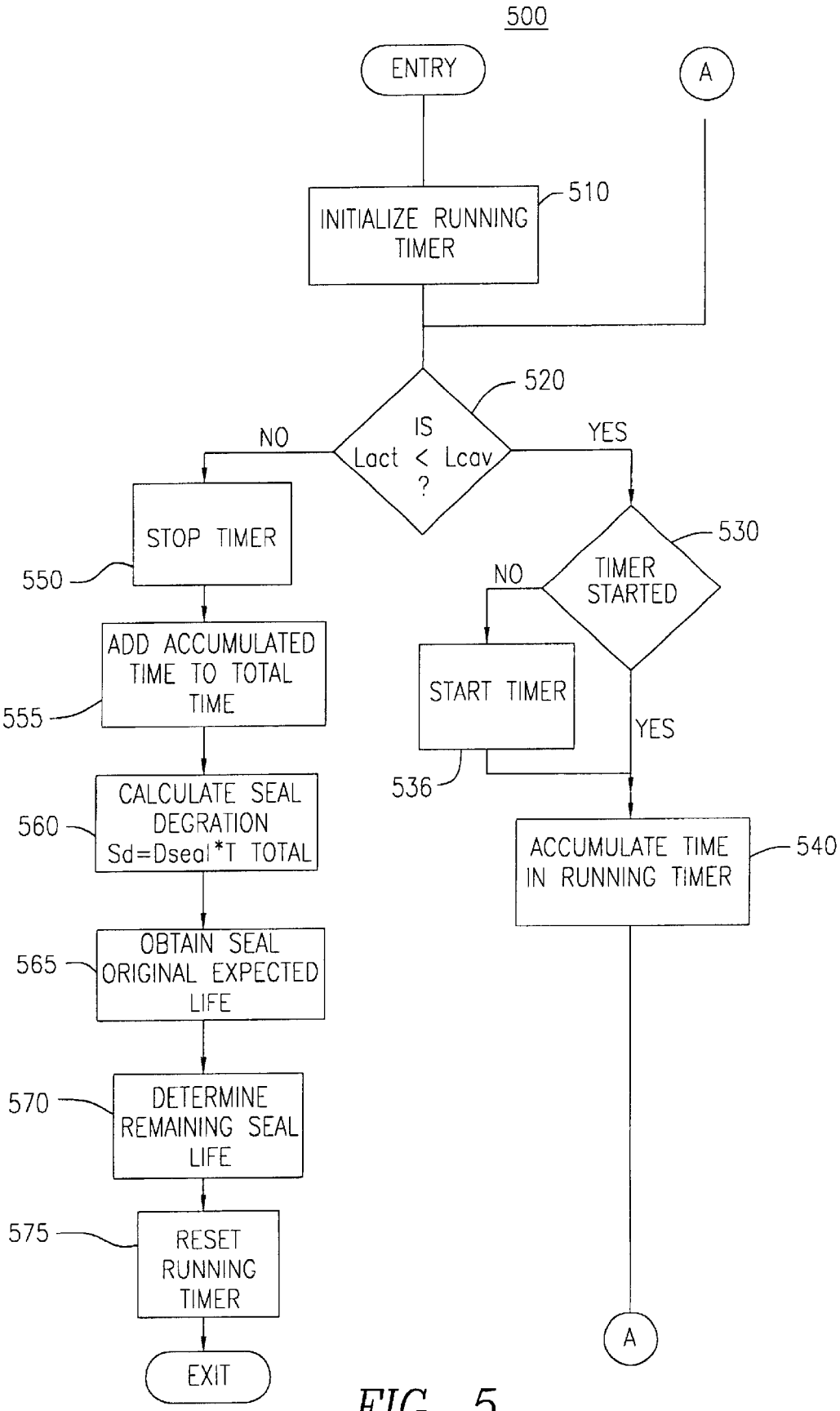
FIG. 5 illustrates an exemplary processing flow chart for determining degradation on mechanical seal life in accordance with the principles of the invention.

FIG. 5 illustrates an exemplary processing flow chart 500 for determining the degradation of a mechanical seal caused by cavitation and the remaining mechanical seal operational life or usefulness. In this exemplary flow, a running timer of fluid cavitation is initialized at block 510. At block 520 a determination is made whether a measured RMS pressure (Lact) is less than a determined cavitation alarm pressure (Lcav). If the answer is in the affirmative, then a determination is made at block 530 whether a timer has already been started. If the answer is in the negative, than a timer is started in block 535. Processing then proceeds to block 540 wherein a time duration of a cavitation is accumulated.

If the answer, at block 530, is in the affirmative, then processing proceeds to block 540 to accumulate a time duration that the measured pressure is less than the cavitation alarm pressure. Processing then continues to block 520 to monitor the measured pressure with regard to a determined cavitation alarm pressure.

If, however, the answer, at block 520, is in the negative, then the timer is halted at block 550. The accumulated time or time duration that measured pressure is less than a determined cavitation alarm pressure is then added to a total cavitation time value at block 555. Total cavitation time maintains a record of the accumulated time durations in which measured pressure is less than determined cavitation alarm pressure.

A seal life degradation time factor is next determined, at block 560, as a function of total cavitation time and a seal degradation factor (Dseal). Seal degradation factor is representative of a detrimental effect upon operational seal life caused by fluid cavitation and is obtained through life testing of similar seal materials without benefit of continuous fluid film and/or dry running life test of same seal materials. Seal degradation factor depends on the type of seal, the type of fluid passing through the seal, seal materials, etc.

Remaining time of seal life is next determined, at block 570, by removing the seal life degradation time from an estimated remaining seal life. An estimated remaining seal life may be determined by reducing an original, expected, seal life obtained at block 565 by a known time of pump operation. At block 575, the running timer is reset.

Although the invention has been described and pictured in a preferred form, it is understood that the present disclosure has been made only by way of example, and that numerous changes in the details may be made without departing from the spirit and scope of the invention as hereinafter claimed. For example, although illustrated as applied to an end suction pump, it would be appreciated that the principles of the invention are also applicable to other styles of centrifugal pump, such as double suction, multi-stage, etc., horizontally or vertically oriented. It is intended that the patent shall cover by suitable expression in the appended claims, those features of patentable novelty that exists in the invention disclosed.

We claim:

1. A method for determining cavitation in a pump having a known non-cavitating dynamic pressure measure, comprising the steps of:

determining a cavitation alarm dynamic pressure as a known percentage of said non-cavitating pressure measure;

measuring dynamic pressure in said pump; and comparing said measured dynamic pressure to said cavitation alarm dynamic pressure; and outputting an indicator when said measured dynamic pressure is less than said cavitation alarm dynamic pressure.

2. The method as recited in claim 1 further comprising the steps of:

determining a time duration of the occurrence of cavitation;

determining a seal degradation time in relation to said time duration and a seal degradation factor;

determining a remaining seal life by removing said seal degradation time from a known seal life measure.

3. The method as recited in claim 1 wherein said measured dynamic pressure is measured as a root mean square measure.

4. The method as recited in claim 1 wherein said known percentage of non-cavitation pressure is in the range of 10 to 90 percent.

5. The method as recited in claim 4 wherein said known percentage is 50 percent.

6. The method as recited in claim 1 wherein in the step of outputting an indicator includes:

maintaining a known logic level.

7. The method as recited in claim 1 wherein in the step of outputting an indicator further includes the step of: outputting a second indicator when said measured pressure is greater than said cavitation alarm dynamic pressure.

8. The method as recited in claim 6 wherein a time duration is measured for the duration of said indicator.

9. The method as recited in claim 7 wherein a time duration is measured between the occurrence of said indicator and said second indicator.

10. The method as recited in claim 2 wherein said known seal life measure corresponds to a known expected seal life reduced by a known operational time.

11. A system for determining cavitation in a pump having a known non-cavitating dynamic pressure measure, comprising:

at least one sensor, in communication with said pump, operative to measure dynamic pressure in said pump; and a processor, in communication with said at least one sensor, operative to:

compare said measured dynamic pressure in said pump to a cavitation alarm dynamic pressure, wherein said cavitation alarm dynamic pressure is a known percentage of said non-cavitating pressure measure; and output an indicator when said measured dynamic pressure is less than said cavitation alarm dynamic pressure.

12. The system as recited in claim 11 wherein said processor is further operative to:

determine a time duration of the occurrence of cavitation;

determine a seal degradation time in relation to said time duration and a seal degradation factor;

determine a remaining seal life by removing said seal degradation time from a known seal life measure.

13. The system as recited in claim 11 wherein said measured dynamic pressure is measured as a root mean square measure.

14. The system as recited in claim 11 wherein said known percentage of non-cavitation pressure is in the range of 10 to 90 percent.

15. The system as recited in claim 14 wherein said known percentage is 50 percent.

16. The system as recited in claim 11 wherein said outputted indicator is maintained at a known logic level.

17. The system as recited in claim 11 wherein said outputted indicator includes outputting a second indicator when said measured pressure is greater than said cavitation alarm dynamic pressure.

18. The system as recited in claim 12 wherein said time duration is measured for the duration of said indicator.

19. The system as recited in claim 17 wherein a time duration is measured between the occurrence of said indicator and said second indicator.

20. The system as recited in claim 12 wherein said known seal life measure corresponds to a known expected seal life reduced by an operational time.

21. The system as recited in claim 11 wherein at least one of said at least one sensor is installed in a mechanical seal unit of said pump.

22. The system as recited in claim 11 wherein at least one of said at least one sensor is installed in a suction nozzle area of said pump.

23. A method for determining seal life degradation in a pump having a known non-cavitating dynamic pressure measure, comprising the steps of:

determining a cavitation alarm dynamic pressure as a known percentage of said non-cavitating pressure measure;

measuring dynamic pressure in said pump; comparing said measured dynamic pressure to said cavitation alarm dynamic pressure;

outputting an indicator when said measured dynamic pressure is less than said cavitation alarm dynamic pressure;

determining a time duration of the occurrence of cavitation;

determining a seal degradation time in relation to said time duration and a seal degradation factor; and determining a remaining seal life by removing said seal degradation time from a known seal life measure.

24. The method as recited in claim 23 wherein said measured dynamic pressure is measured as a root mean square measure.

25. The method as recited in claim 23 wherein said known percentage of non-cavitation pressure is in the range of 10 to 90 percent.

26. The method as recited in claim 23 wherein said known percentage is 50 percent.

27. The method as recited in claim 23 wherein in the step of outputting an indicator includes:

maintaining a known logic level.

28. The method as recited in claim 23 wherein in the step of outputting an indicator further includes the step of:

outputting a second indicator when said measured pressure is greater than said cavitation alarm dynamic pressure.

29. The method as recited in claim 23 wherein said time duration is measured for the duration of said indicator.

30. The method as recited in claim 28 wherein said time duration is measured between the occurrence of said indicator and said second indicator.

31. The method as recited in claim 23 wherein said known seal life measure corresponds to a known expected seal life reduced by a known operational time.

32. A system for determining cavitation in a pump having a known non-cavitating dynamic pressure measure, comprising:

at least one sensor, in communication with said pump, operative to measure dynamic pressure in said pump; and a processor, in communication with said at least one sensor, operative to:

compare said measured dynamic pressure in said pump to a known percentage of said non-cavitating measure; and determine a remaining seal life based in part upon said comparison.

33. A method for determining seal life degradation in a pump having a known non-cavitating dynamic pressure measure, comprising the steps of:

measuring dynamic pressure in said pump;

comparing said measured dynamic pressure to a known percentage of said non-cavitating pressure measure; and determining remaining seal life based in part upon said comparing step.

* * * * *